US008340334B2

(12) United States Patent
Suyama

(10) Patent No.: US 8,340,334 B2
(45) Date of Patent: Dec. 25, 2012

(54) EAR MOLD

(75) Inventor: Keita Suyama, Chiba (JP)

(73) Assignee: Suyama Dental Laboratory Inc., Chiba-shi (JP)

( * ) Notice: Subject to any disclaimer, the term of this patent is extended or adjusted under 35 U.S.C. 154(b) by 982 days.

(21) Appl. No.: 11/883,504

(22) PCT Filed: Jan. 24, 2006

(86) PCT No.: PCT/JP2006/001060
§ 371 (c)(1),
(2), (4) Date: May 27, 2008

(87) PCT Pub. No.: WO2006/082735
PCT Pub. Date: Aug. 10, 2006

(65) Prior Publication Data

US 2009/0141920 A1 Jun. 4, 2009

(30) Foreign Application Priority Data

Feb. 1, 2005 (JP) ..... 2005-025517

(51) Int. Cl.
*H04R 25/00* (2006.01)

(52) U.S. Cl. ..... 381/328

(58) Field of Classification Search ..... 381/328
See application file for complete search history.

(56) References Cited

U.S. PATENT DOCUMENTS 3,921,756 A * 11/1975 Johnson ..... 181/135
4,381,830 A * 5/1983 Jelonek et al. ..... 181/129
4,520,236 A * 5/1985 Gauthier ..... 381/324
4,852,683 A * 8/1989 Killion ..... 181/130
4,977,976 A * 12/1990 Major ..... 181/130
5,031,219 A * 7/1991 Ward et al. ..... 381/328

(Continued)

FOREIGN PATENT DOCUMENTS

EP 1448015 A1 8/2004

(Continued)

OTHER PUBLICATIONS

Written Answer in International Searching Authority.

*Primary Examiner* — David S. Warren
(74) *Attorney, Agent, or Firm* — Westerman, Hattori, Daniels & Adrian, LLP

(57) ABSTRACT

[Technical Problem] In regard to an ear mold for a hearing aid, there are provided the ear mold which a metal bush is settled in a tube for joint of the hearing aid, said metal bush has been used on account of settlement of said tube for joint of the hearing aid, and which a tube is adhered by an adhesive, the adhesive has been used on account of settlement of said tube. However, said ear mold has disadvantages that said tube is easily moved for the reason of instability, said tube drops out from the ear mold, and the ear mold occurred the problem of a phenomenon of a howling by sound leak-out.

[Technical Solution] The ear mold which is configured by embedding a connection and fixation member (A hub) 2 having a hole for connection to a hearing aid body and an introductory-hole of a forming material of said ear mold 2010 into the ear mold 1 on the basis of an ear impression. The connection and fixation member (the hub) 2 is embedded into the ear mold 1 when molding of the ear mold.

4 Claims, 8 Drawing Sheets

U.S. PATENT DOCUMENTS

| | | | | | |
|---|---|---|---|---|---|
| 5,113,967 | A | * | 5/1992 | Killion et al. | 181/132 |
| 5,146,051 | A | | 9/1992 | Hermann | |
| 5,201,007 | A | * | 4/1993 | Ward et al. | 381/328 |
| 5,321,757 | A | * | 6/1994 | Woodfill, Jr. | 381/312 |
| 5,488,205 | A | * | 1/1996 | Major | 181/129 |
| 5,887,070 | A | * | 3/1999 | Iseberg et al. | 381/380 |
| 5,975,235 | A | * | 11/1999 | Schlaegel et al. | 181/129 |
| 6,129,174 | A | * | 10/2000 | Brown et al. | 181/135 |
| 6,253,871 | B1 | * | 7/2001 | Aceti | 181/135 |
| 2004/0252854 | A1 | | 12/2004 | Juneau et al. | |

FOREIGN PATENT DOCUMENTS

| | | | |
|---|---|---|---|
| JP | 08-195999 | A | 7/1996 |
| WO | 2006-082735 | A2 | 8/2006 |

* cited by examiner

EAR MOLD

FIELD OF THE INVENTION

The present application relates to an ear mold in an ear hook hearing aid, specifically to an ear mold which may be inserted into an external auditory meatus (external ear cavity), and to an ear mold of an ear hook hearing aid which may be hanged behind the section of an ear pinna.

BACKGROUND OF THE INVENTION

A hearing aid may be used by one who is hard of hearing and so on.

The hearing aid comprises a microphone which may receive external sound, a speaker which transmits sound into an ear, a body portion having an electric device (including an electric battery) which may drive the microphone and the speaker, and the ear mold which may be inserted into an ear (the external auditory meatus) and may be joined to said body portion.

Whatever an efficiency of the body portion of a hearing aid may be raised, and when the ear mold cannot be adapted to a user, it gives the user an unpleasant feeling and it cannot maintain a proper tone quality. In the ear mold for the hearing aid, the problem occurs of a high pitched sound and sound leak-age (what is also called a phenomenon of a howling).

Regarding the ear mold for the hearing aid, lately, the ear mold of a custom-made hearing aid, which is produced according to the shape of the ear of a user, has been recommended as the above-mentioned ear mold. However, said custom made ear mold causes problems. For example, it gives a feeling of incompatibility for the user, and easily falls out of the user's ear. Further, it also has the know phenomenon of "howling."

The material that ear molds have been formed out of include an MMA (methylmethacrylate) resin, for example. Lately a silicon resin has been used as the forming material. As the silicon resin can reduce a burden when in contact with the external auditory meatus, and does not cause an allergic reaction, the silicon resin can be adapted for the above-mentioned use.

For manufacturing of the custom made ear mold, generally a forming material which takes an impression, such as silicon, is inserted into the external auditory meatus of the user. After hardening, an ear impression is created. After spreading wax or the like in the surface of said ear impression, a plaster is poured into the mold of said ear impression. Said ear impression is thus made from said pattern. After removing the wax and/or paraffin wax from said ear impression, a pattern of plaster is made based on the ear impression. The forming material of the ear mold, such as the silicon resin, is poured into said pattern of plaster. After the ear mold has hardened the custom made ear mold is obtained.

Heretofore said silicon ear mold shown in FIG. 8A, was prepared by the above-mentioned method and based on an ear impression of the user. However, the silicon ear mold can also be made by as follows.

A tube 802 passes into a lead-sound-hole of the silicon ear mold 801. This tube 802 passes through said ear mold 801 as shown in FIG. 8A. The metal bush 803, as shown in FIG. 8B, fits into an end section of this tube 802. Tube 802 pulls back because the metal bush 803 is put into an end section of the silicon ear mold 801. In this case, said metal bush 803 has been used because of settlement of the above-mentioned tube 802.

However, said silicon ear mold has a disadvantage such that said tube 802 is easily moved due to instability, because said tube 802 is settled by said metal bush 803.

Also, said silicon ear mold has the disadvantage that the tube 802 is destroyed by stress which is concentrated on the above-mentioned end section of ear mold 801 when the ear mold is removed. Additionally, tube 802 also drops out from the ear mold 801.

Further, in case of small of the external auditory meatus, the tube 802 cannot maintain the necessary thickness for maintaining the rigidity of the silicon material because the tube 802 is put in the inside of an ear mold 801 and the tube 802 its own thickness.

Furthermore, if the thickness of the tube 802 is increased, the ear mold has a surplus thickness at the portion of the external auditory meatus.

On the other hand, there is provided the silicon ear mold 701 as shown in FIG. 7 which is manufactured by the previously-mentioned method. In this silicon ear mold 701, a plastics-elbow or nylon-L-tube 702 is inserted into the lead-sound-hole of silicon ear mold 701 as shown in FIG. 7. The plastics-elbow or nylon-L-tube 702 is connected with the silicon ear mold 701 by an adhesive. Namely, said plastics-elbow or nylon-L-tube 702 is fixed by the glued-part 703 of said plastics-elbow or nylon-L-tube 702 on the inside of said silicon ear mold 701. In said silicon ear mold 701, as shown in the drawings, an end portion of the plastics-elbow or nylon-L-tube 702 is connected by an adhesive to the inside of said silicon ear mold 701.

As shown in the drawings, the other end portion of the tube for joining the hearing aid (vinyl tube) 704 may be joined with said plastics-elbow or nylon-L-tube 702.

In said silicon ear mold, the plastics-elbow or nylon-L-tube 702 is not secure inside the silicon ear mold 701. Said plastics-elbow or nylon-L-tube 702 is cut off.

Therefore, said plastics-elbow or nylon-L-tube 702 can be in the case of a small external auditory meatus. Said plastics-elbow or nylon-L-tube 702 is different from said silicon ear mold 801 as previously mentioned and as shown in FIG. 8.

For the reason of stiffness of said vinyl tube 704, which increases with use, it is necessary to periodically change said vinyl tube 704. Vinyl tube 704 is not a single body, and is independent from said ear mold 701, through the intervention of said plastics-elbow or nylon-L-tube 702. Thus, the exchange is easy.

But, said silicon ear mold has a problem that the between the plastics-elbow or nylon-L-tube 702 and the earl mold 701 decreases. Consequently, the plastics-elbow or nylon-L-tube 702 detaches easily and drops out from said ear mold 701. As such, the phenomenon of howling occurs due to sound leaking-out.

SUMMARY

Technical Problem

It is an object of the present application to provide a technology which can be solve the problems of the prior art technologies.

The above and other objects and novel features of the present disclosure will become apparent from the following specification and drawings.

Technical Solution

An ear mold for a hearing aid based on an ear-impression, said ear mold comprising:

a first tube on an ear-hook-aid-side of said ear mold, a second internal tube, a connection and fixation member having an opening for attaching said first tube to said connection and fixation member, said connection and fixation member includes an introductory hole, by which said connection and fixation member is attached to said ear mold, said ear mold has a sound-leading-hole formed by a cavity in said ear mold.

In another aspect of the embodiment of the ear mold, said first tube comprises: a plastic elbow or a nylon L-shaped elbow.

According to another aspect of the embodiment of the ear mold, said-ear mold is made from a silicon resin.

In another embodiment, a method of manufacturing an ear mold comprises: forming a lug plug section which is designed to be inserted into an external auditory meatus of user, and after said material hardens, forming an ear mold based on an ear-impression, embedding a connection and fixation member having an opening which receives a first tube, forming an introductory hole said connection and fixation member, forming a sound-leading tube in said ear mold, such that a hollow part of said ear mold is the sound-leading tube, locating the connection and fixation member adjacent to said sound-leading tube and adjacent to said first tube.

The ear mold of the present application has following advantages.

(1) Improved Stability of Use

The ear hook hearing aid is named "the ear hook hearing aid" where the body portion of the ear hook hearing aid hangs behind the section of an ear pinna and hooks on to the ear.

In order to stabilize said body portion of the ear hook hearing aid to the section behind the ear pinna, it is necessary to have cooperation between the ear mold and the ear hole.

If too much soft material is used as the tube for the joining of the hearing aid, the hearing aid will not be adequately stable.

Therefore, in the present invention, the connection and fixation member is embedded into the ear mold and introduces the forming material of the ear mold into the ear mold through an introductory-hole for the forming material of the ear mold in said connection and fixation member.

Therefore, according to the present invention, said connection and fixation member can be connected with the forming material of the ear mold and said connection and fixation member can be fixed to said ear mold.

Therefore, according to the present invention, said connection and fixation member is able to be fixed in said ear mold, and can be stabily supported by the tube for joining the hearing aid.

Therefore, the present invention improves the stability of the hearing aid when the ear mold is used.

(2) The Prevention of Dislodging of the Tube for Connection to a Hearing Aid (Prevention of Dislodging of L-Tube)

In a standard ear mold, the fixed part of the tube etc. for connection, was located between the body portion of the ear mold and the hearing aid. Special parts contacted the ear mold made a solid connection difficult and caused the tube to drop out from the ear mold after a long-time in use. Consequently the problem of a howling sound caused.

On the other hand, according to the present invention, the ear mold wherein the tube does not drop out from said ear mold caused by removal of the ear mold, can obtained even after long periods of use.

In the present invention the connection and fixation member embeds into the ear mold and allows the introduction of the forming material of the ear mold into the ear mold, through an introductory-hole. Thus, according to the present invention said connection and fixation member can be contacted with the forming material of the ear mold and said connection and fixation member can be fixed to said ear mold.

(3) Prevention of the Tube for Joining the Hearing Add from Floating

When the ear mold is placed into the ear, it is desirable that the tube for joining the hearing aid does not experience floating from the point of the joint of the ear mold, to the ear mold. This is because when said floating is produced at said joint, a hand or finger etc. could become momentarily stuck on said joint, resulting in the hearing aid becoming easily detached from the ear.

On the other hand, according to present invention, the direction (angle) of the tube for joining the hearing aid can be controlled properly at the time of making the mold. Thus the present invention can be solved the above mentioned problems.

For the user of the hearing aid, it is desirable that the ear mold and the tube be inconspicuous. This can be accomplished by hiding said ear mold and tube by the person's hair.

According to present invention, the direction (angle) between the connection and fixation member and the tube for joining the hearing aid can be properly changed at the time of making the mold. Thus the present invention can be solve the above mentioned problems.

(4) Simplify the Exchange of the Tube for Joining the Hearing Aid

The tube for joining the hearing aid is necessary to exchange for reasons such that said tube can crack and stiffen over time.

Heretofore it has been necessary to remove these parts. However, said removal of parts is difficult.

However, according to the present invention, said tube can be easily replaced because said tube is joined with the tube for joining the ear-mold-side through a plastic-elbow or nylon L-tube, and said tube is independent from the ear mold.

1 The ear mold

2 The connection and fixation member for a tube for connection to a hearing aid (the hub)

3 The tube for joint of the hearing aid

200 The joint portion

201 The body portion

2000 The joint-hole for the tube joint of ear-mold-side

2010 The introductory-hole for a forming material of the ear mold

BEST MODE FOR CARRYING OUT THE INVENTION

Examples of the present invention will be described according to the drawings.

EXAMPLES

Figure 1:
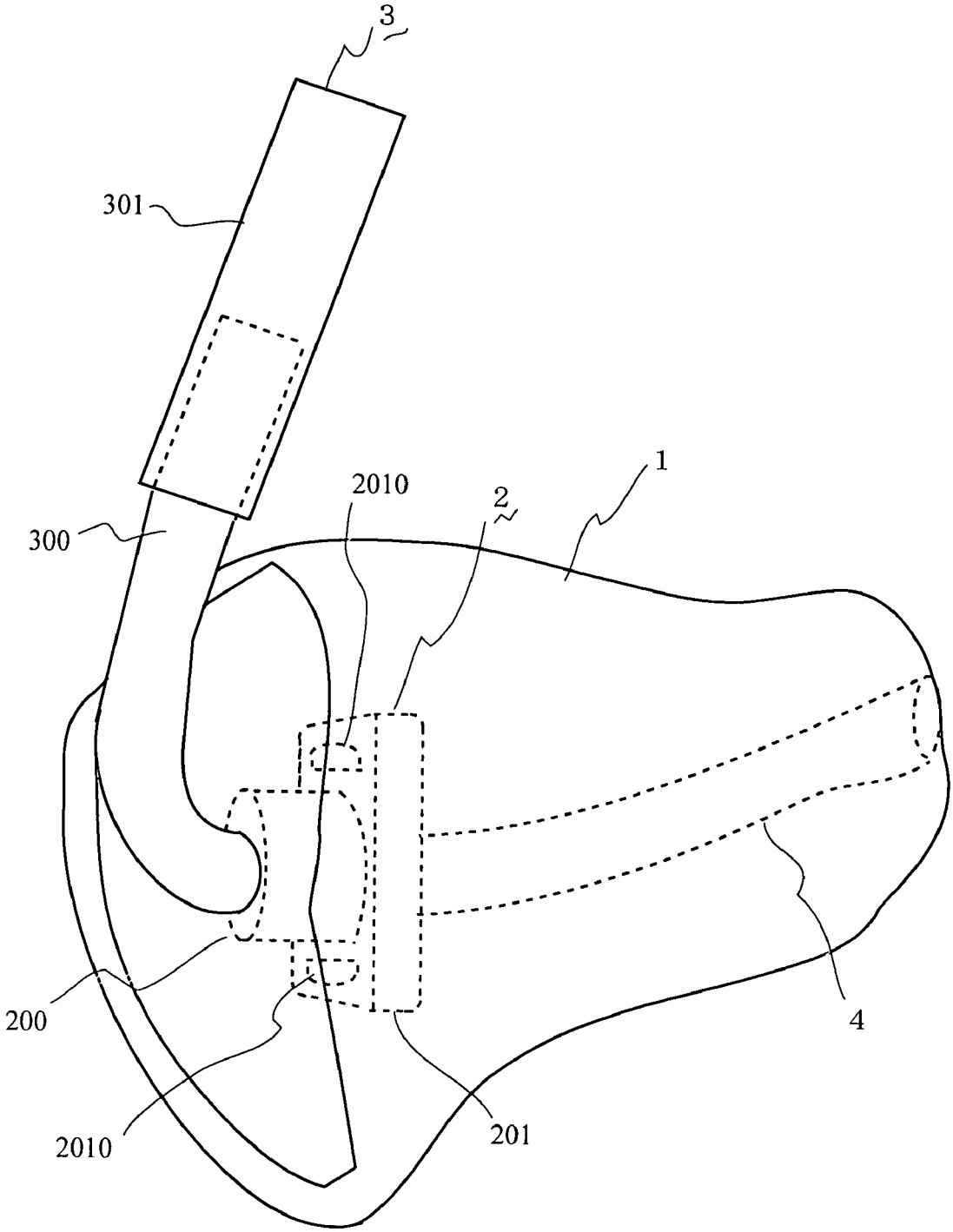
FIG. 1 is example of a schematic view of the ear mold embodying the present invention.
Figure 2:
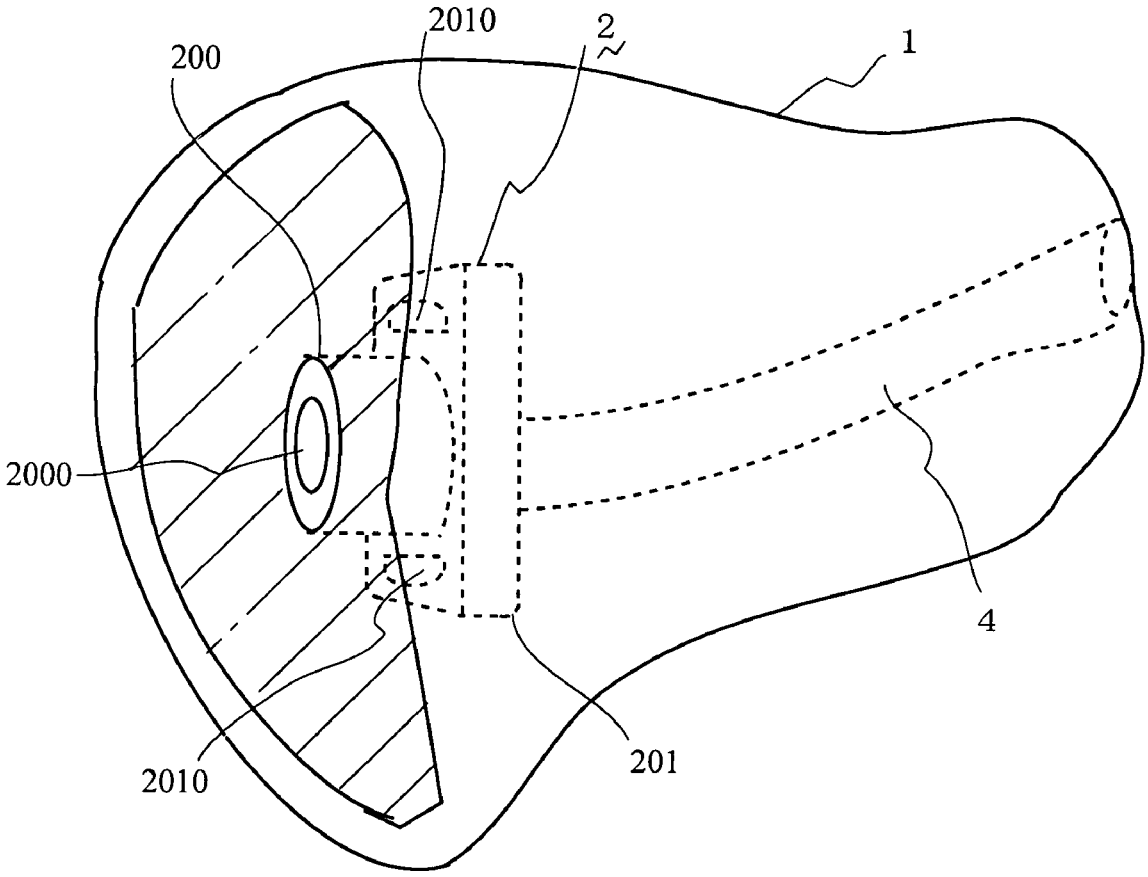
FIG. 2 is partial schematic view of the ear mold embodying the present invention.
Figure 3:
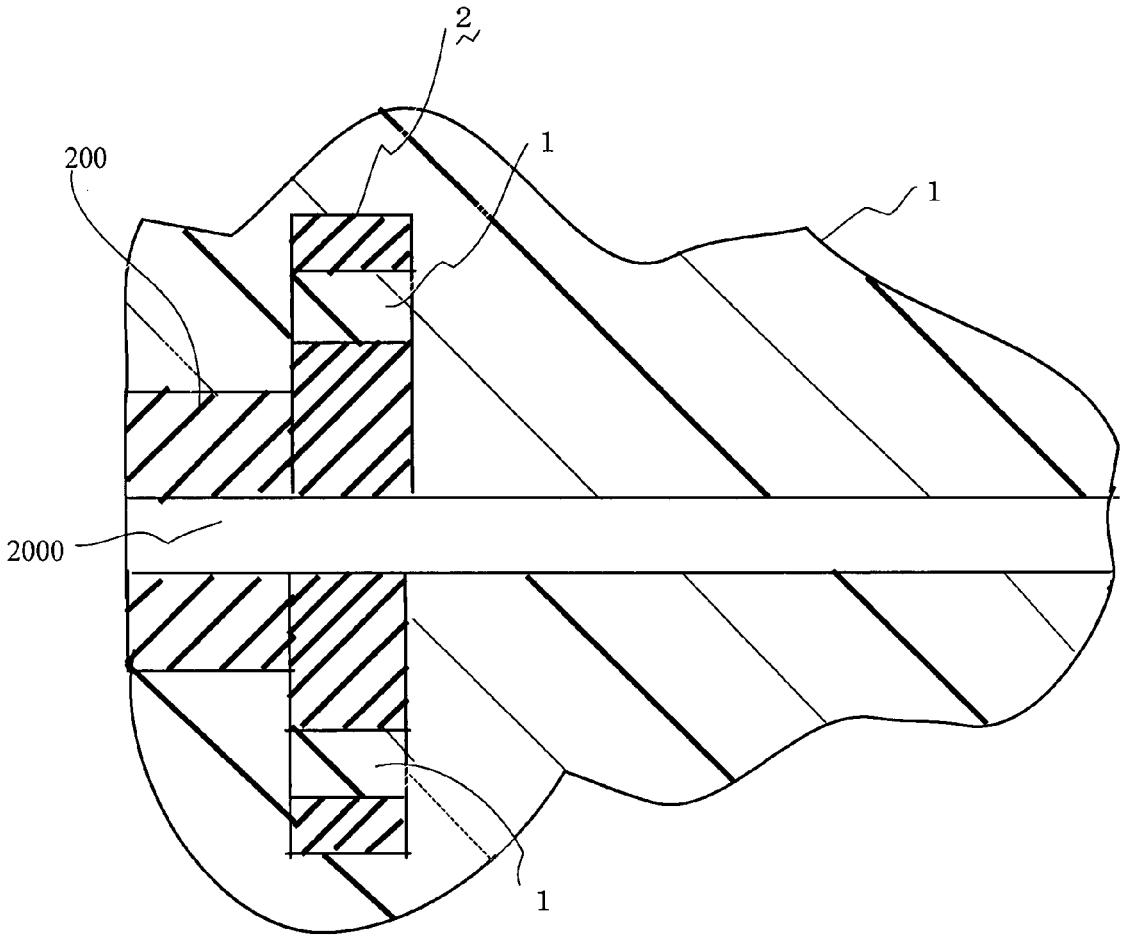
FIG. 3 is partial sectional view of the ear mold embodying the present invention.

As shown in FIG. 1, FIG. 2 and FIG. 3, in the present invention, the connection and fixation member 2 is embedded in the ear mold 1.

Said connection and fixation member 2 comprises the joint portion 200 and the body portion 201.

Said joint portion 200 has the joint-hole for the tube joint of the ear-mold-side 2000 and said body portion 201 has the introductory-hole for the forming material of the ear mold 2010.

In the ear mold of the present invention, as shown in the drawings, the connection and fixation member (hereinafter referred to as a hub) 2 is embedded into the ear mold 1.

The custom made ear mold of the present invention can be manufactured as follows.

The forming material for the lug plug section such as silicon material is inserted into the external auditory meatus of the user and then allowed to harden. Then an ear-impression is made by means of the molding (forming). After that, said ear-impression has the same shape as that of the external auditory meatus of the user. Then the forming material of the ear mold is poured into a pattern of plaster based on said ear-impression. Then the forming material of the ear mold is allowed to harden. The molded (shaped) ear mold can then be obtained.

In the present invention, during the molding (shaping) of the ear mold based on the above-mentioned method, said hub 2 is embedded into the ear mold 1 and allows the introduction of the forming material of the ear mold 1 into the ear mold 1 through an introductory-hole.

Therefore, according to the present invention, said hub 2 can contact the forming material of the ear mold 1 and can be fixed with said ear mold 1.

Therefore, according to the present invention, said hub 2 is able to be immobile in said ear mold 1, and can be supported and stabilized at the joint of the tube for joining the hearing-aid. This point is different from the prior art in that the metal bush 803 is put into an end section of the traditional tube 802, as in shown FIG. 8, and then said tube 802 can move due to unsettlement.

Figure 7:
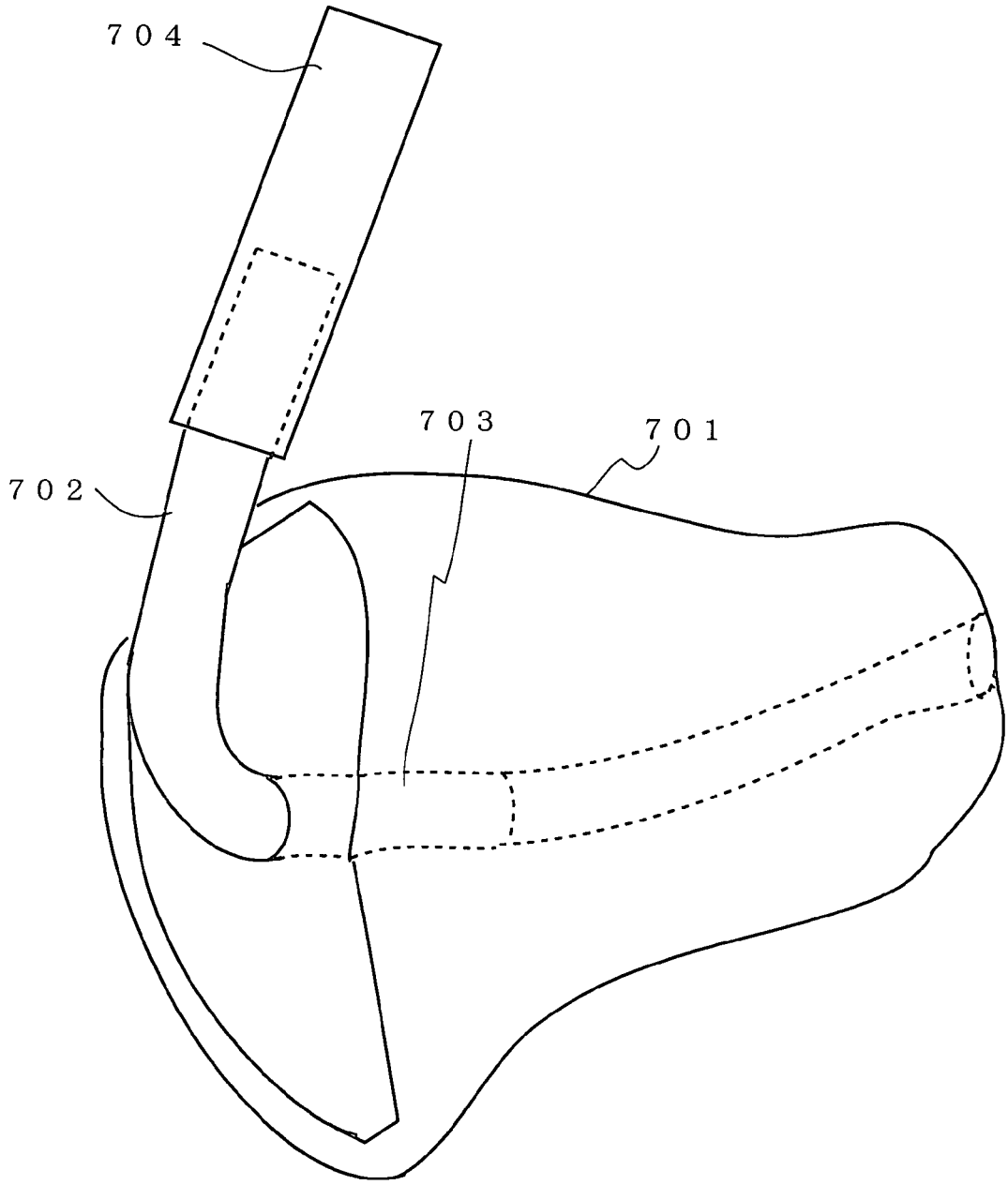
FIG. 7 (PRIOR ART) is schematic view showing examples of conventional ear mold.

According to the present invention, said hub 2 can contact the forming material of the ear mold 1 and can be fixed with said ear mold 1. This is different from the prior art in that said silicon ear mold 701 as shown in FIG. 7 has the problems of lack of insufficient adhesion and causes the occurrence of howling by said plastics-elbow or nylon-L-tube 702 easily detaching or dropping out of said ear mold 701.

Figure 4:
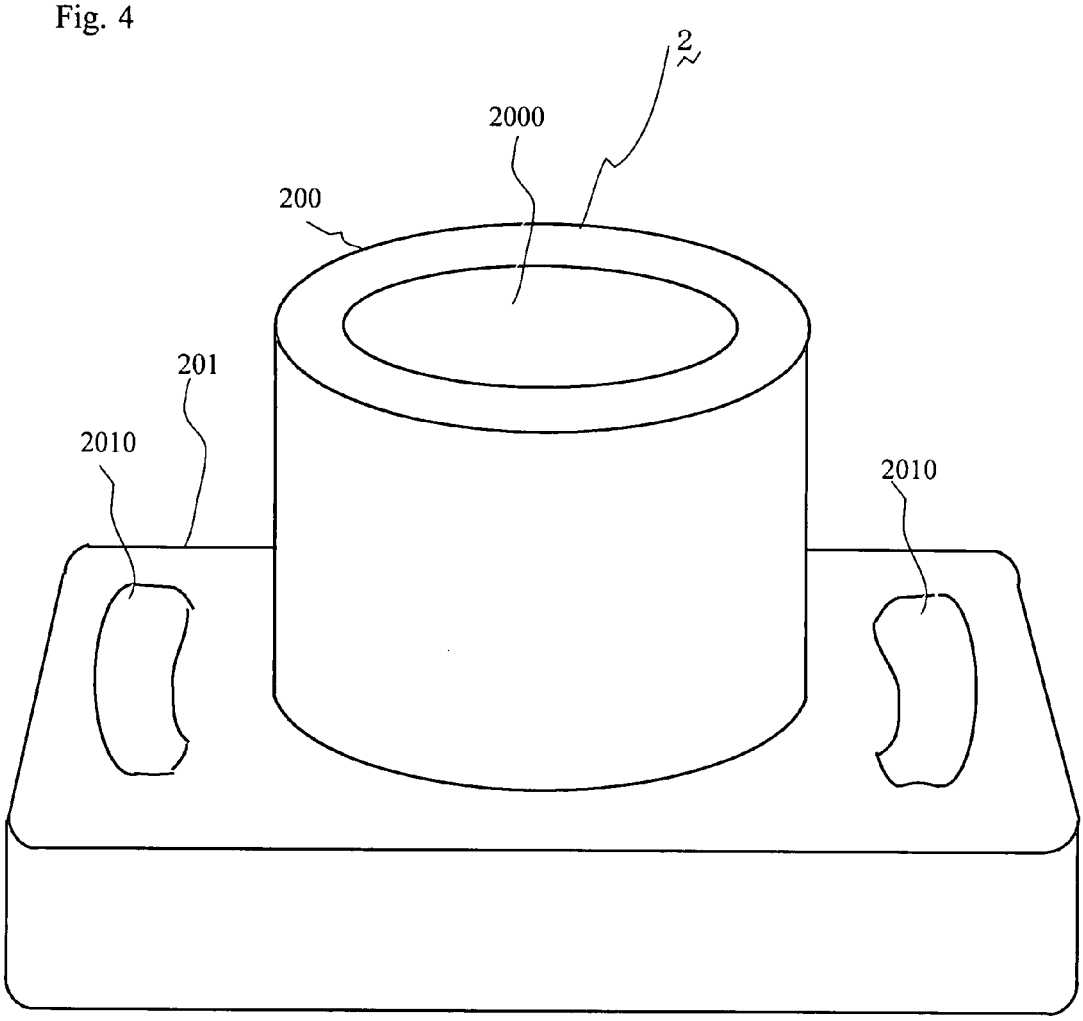
FIG. 4 is schematic view of the hub embodying the present invention.
Figure 5:
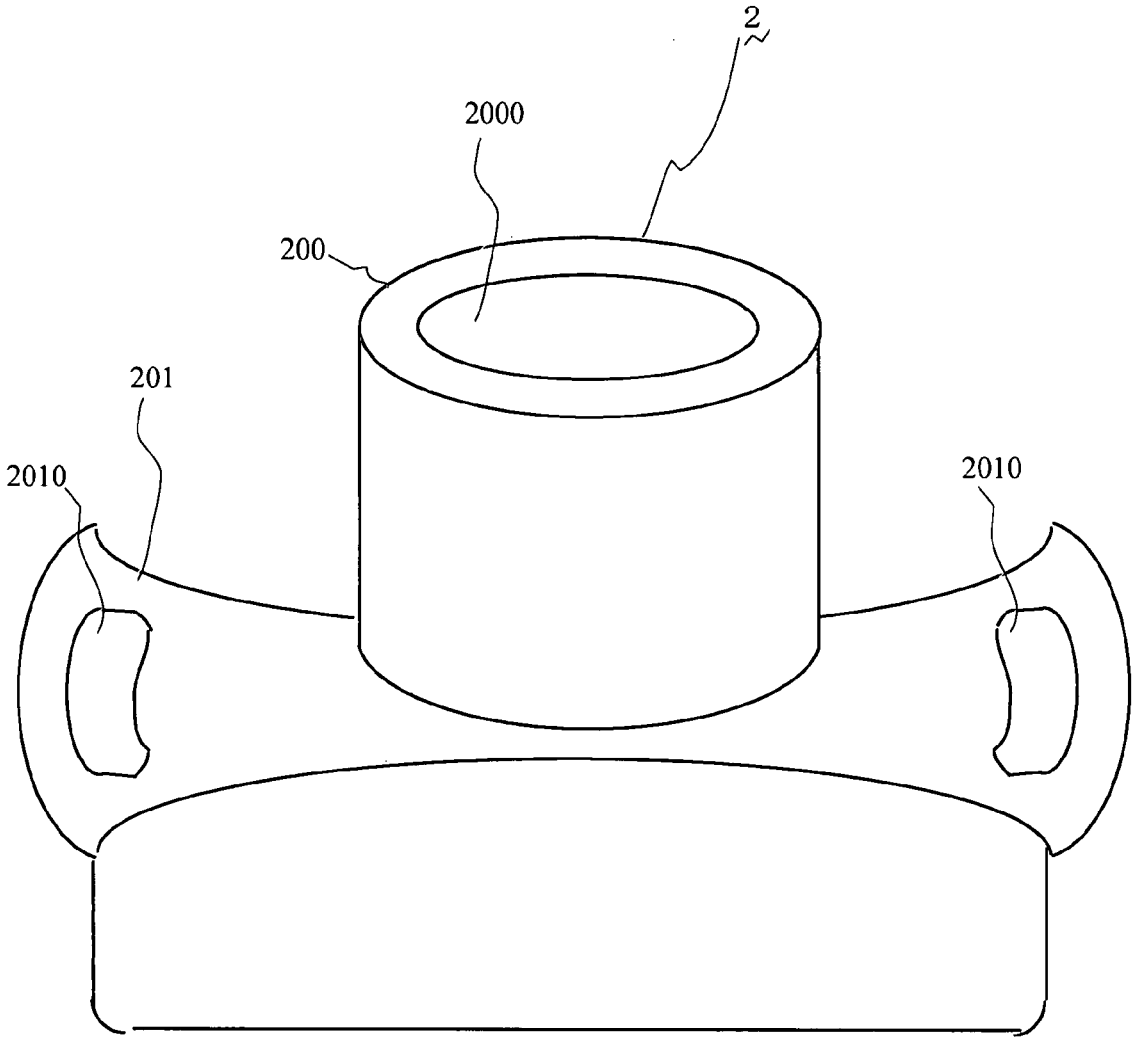
FIG. 5 is schematic view of the hub the other embodying the present invention.
Figure 6:
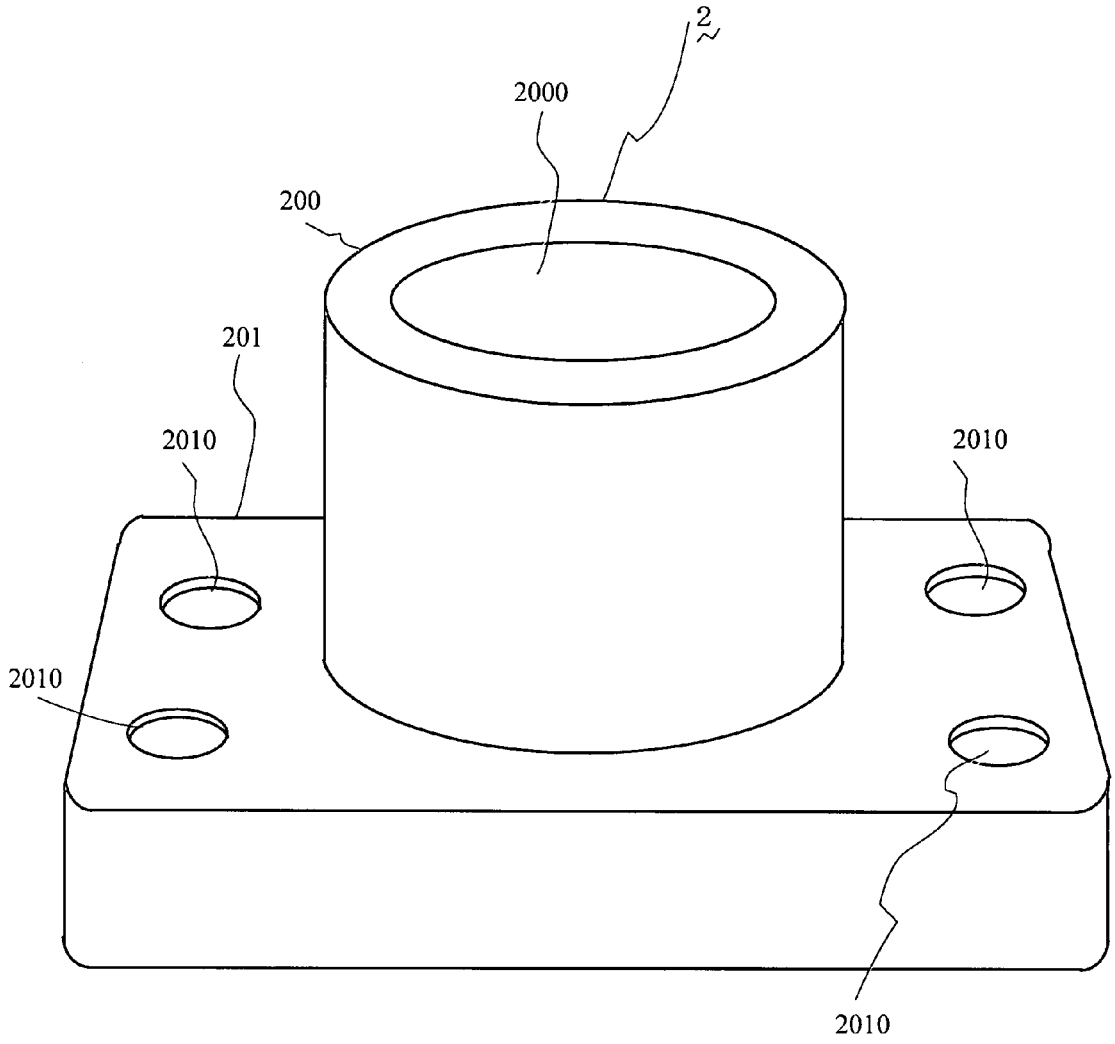
FIG. 6 is schematic view of the hub still more the other embodying the present invention.

Two or three examples of the hubs are shown in FIG. 4, FIG. 5 and FIG. 6.

The body portion of the hub 2 may be composed a rectangular cube, for example, as shown in the drawings.

As shown in the drawings, the body portion of said hub 2 has the introductory-hole for a forming material of the ear mold 2010 in both side end portions of said hub 2.

The joint portion 200 of the tube for joining the ear-mold-side of said hub 2 comprises a circular cylinder, for example, as shown in the drawings, and has the joint-hole for the tube joint of ear-mold-side 2000 in the central portion.

FIG. 5 shows the example having the part of a curve in the part of the body portion of the hub 2.

Therefore, said hub 2 may be contacted with the ear mold 1 all the more, and the attachment between said hub 2 and the ear mold 1 may be more secure. Further, said hub 2 may be miniaturized.

FIG. 6 shows an example of an increased number of introductory-holes for the forming material of the ear mold 2010 in the body portion of the hub 2. For example, said total number of introductory-holes may be four with two introductory-holes in each side of the end portion of hub 2.

Therefore, said hub 2 may contact the forming material of the ear mold 1 even more, and the attachment between said hub 2 and the ear mold 1 may be even greater. Said hub 2 in the ear mold can stable because of the reduction of revolutions.

In the joint-hole for the tube joint of ear-mold-side 2000 of the joint portion 200 of said hub, said hub 2 may be joined with the tube for joining the hearing aid 3, as shown in FIG. 1.

This tube for joining the hearing aid 3 may be composed by a plurality of tubes.

Said tube for joining the hearing aid 3 comprises the tube for joining the ear-mold-side which is joined with the ear mold 300 and the tube for joining the ear-hook-hearing-side in need of replacing 301.

Said joining tube of the ear-mold-side 300 may comprise the plastics-elbow or nylon-L-tube, for example. Said tube of the ear-mold-side 300 may be joined with the tube for joining the ear-hook-hearing-side in need of replacing 301.

Said joint tube of the ear-hook-hearing-side 301 may comprise the tube made a polyvinylchloride, for example.

For example, the joint of said hub 2 with said joint tube of the ear-mold-side 300 may be attached with an adhesive.

Said joint tube of the ear-mold-side 300 is cut off at the desirable length, and said joint tube of the ear-mold-side 300 may be joined with the hub 2, fixed at the end portion of the ear mold 1.

Said joint tube of the ear-mold-side 300 can be flexible in case of a small external auditory meatus, because said joint tube of the ear-mold-side 300 is not put into the ear mold 1.

Figures 8A, 8B:
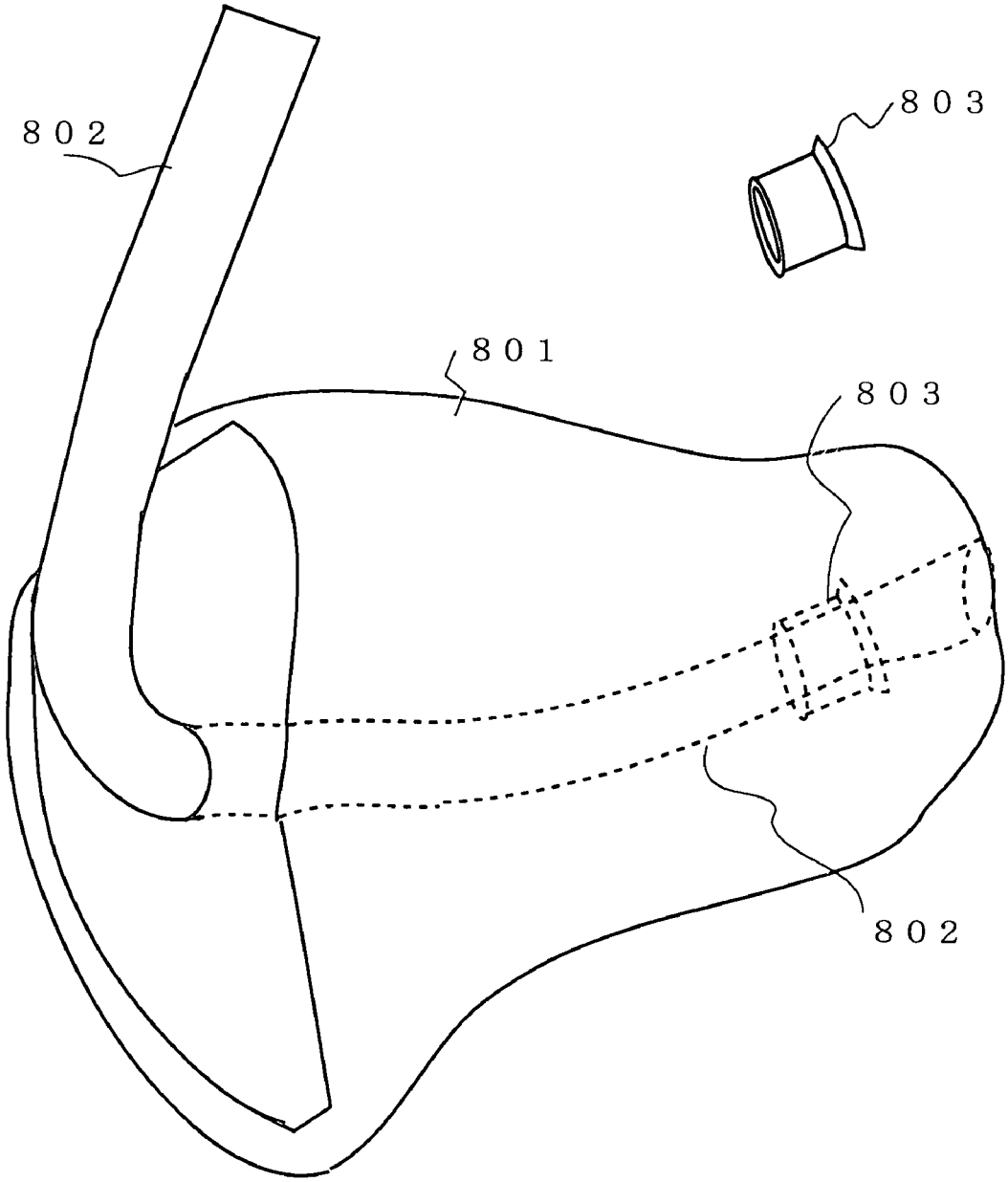
FIG. 8A (PRIOR ART) is schematic view showing examples of conventional ear mold.
FIG. 8B (PRIOR ART) is schematic view showing made of the metal bush (a bushing) for use in the above-mentioned ear mold as shown in FIG. 8A.

This feature is different from prior art in that the tube 802 is put into the silicon ear mold 801, such as that shown in. FIG. 8 of the present application.

Said tube of ear-mold-side 300 can be joined with the ear mold 1 by properly setting the angle. In the ear mold, if the set-angle (direction) of said joint tube of the ear-mold-side 300 is not proper, said ear mold, said joint tube of the ear-mold-side 300 and said joint tube of the ear-hook-hearing-side 301 will float in the ear of the user. Therefore, an opening occurs between the joint tubes 300-301 and the ear mold. Furthermore, the hand and finger etc. can become stuck on said opening, and said joint tubes 300-301 become easily detached from the ear.

According to the present invention, the position relationship of the hub can be controlled at the time of making the mold, and the direction (angle) of said joint tube of the ear-mold-side 300 can be set. Said joint tube of ear-mold-side 300 can be an inconspicuous attachment to the ear and can be covered by hair.

The forming materials of the ear mold in the present invention can preferably use a silicon material.

Silicon resin can be cited as an example of said silicon material. Said joint tube of the ear-hook-hearing-aid in need of replacement 301, can be formed by the tube of polyvinylchloride. Said joint tube 301 is necessary to be regularly replaced, because said joint tube 301 becomes stiff with time.

Said tube 301 can be replaced easily because said tube 301 is joined with said joint tube of the ear-mold-side 300 and said tube 301 is independent from the ear mold 1.

The ear mold 1 has the sound-leading-hole as shown in FIGS. 1, 2 and 3.

This sound-leading-hole may be formed by picking the ear impression of hardened plaster from a flask (mold vessel), disposing of a wire having a fixed-diameter, and molding the silicon material to the forming material of the ear mold.

In the present invention, a bent-hole (an air-hole) can be arranged.

The present invention is not limited to the above-mentioned specific embodiments and various change and modifications may be made, for example, embodiment that the ear mold join with the body portion of the hearing aid by two tubes has shown in above-mentioned, but more than three tubes may be applied.

INDUSTRIAL APPLICABILITY

The present invention may be applicable to molding by the other forming material besides a silicon forming material.

The invention claimed is:

1. An ear mold for a hearing aid based on an ear-impression, said ear mold comprising:

a first tube on an ear-hook-aid-side of said ear mold, a second internal tube, a connection and fixation member having a first opening for attaching said first tube to said connection and fixation member and having a second opening connecting said second internal tube to said connection and fixation member, said connection and fixation member includes an introductory hole, by which said connection and fixation member is attached to said ear mold, wherein said ear mold penetrates and surrounds the introductory hole in order to secure the connection and fixation member to said ear mold, and said ear mold has a sound-leading-hole formed by a cavity in said ear mold.

2. The ear mold according to claim 1, wherein said first tube comprises:

a plastic elbow or a nylon L-shaped elbow.

3. The ear mold according to claim 1, wherein said-ear mold is made from a silicon resin.

4. A method of manufacturing an ear mold comprising:

forming a lug plug section which is designed to be inserted into an external auditory meatus of user, and after said material hardens forming an ear mold based on an ear-impression, embedding a connection and fixation member having an opening which receives a first tube, forming a sound-leading hole in said ear mold, such that a hollow part of said ear mold is the sound-leading hole, locating the connection and fixation member adjacent to said sound-leading hole and adjacent to said first tube, and forming an introductory hole in an outside of said connection and fixation member so that the ear mold surrounds and penetrates the introductory hole, securely fastening the connection and fixation member to said ear mold.

* * * * *